US005171113A

United States Patent [19]

Hove

[11] Patent Number: 5,171,113

[45] Date of Patent: Dec. 15, 1992

[54] REMOVABLE CUSHIONED CONTAINER FLAT

[75] Inventor: Johan Hove, Vallentuna, Sweden

[73] Assignee: Buffers AB, Taby, Sweden

[21] Appl. No.: 747,079

[22] Filed: Aug. 19, 1991

Related U.S. Application Data

[63] Continuation-in-part of Ser. No. 586,785, Sep. 24, 1990, abandoned.

[51] Int. Cl.[5] ..... B61P 45/00

[52] U.S. Cl. ..... 410/88; 410/31; 410/86; 248/602

[58] Field of Search ..... 248/573, 602, 631, 638; 410/52, 82, 83, 86, 87, 88, 90, 91, 31

[56] References Cited

U.S. PATENT DOCUMENTS

| | | | |
|---|---|---|---|
| 3,128,980 | 4/1969 | Udstad et al. | 410/86 |
| 3,143,082 | 8/1964 | Austgen | 410/88 |
| 3,163,127 | 12/1964 | Gurridge et al. | 410/86 |
| 3,167,028 | 1/1965 | Gutridge et al. | 410/86 |
| 3,250,232 | 5/1966 | Aquino et al. | 410/88 X |
| 3,251,314 | 5/1966 | Gutridge | 410/86 |
| 3,371,899 | 3/1968 | Johnson | 410/88 |
| 4,591,307 | 5/1986 | Clive-Smith | 410/83 |
| 4,611,962 | 9/1986 | Braly et al. | 410/82 X |
| 4,650,381 | 3/1987 | Durkin | 410/82 X |
| 4,957,399 | 9/1990 | Hove | 410/88 X |

*Primary Examiner*—Frank E. Werner
*Assistant Examiner*—James Eller
*Attorney, Agent, or Firm*—Browdy and Neimark

[57] ABSTRACT

A cargo carrying flatrack used as an intermediate separate unit between a cargo container and a ISO vehicular load carrier. The flatrack provides longitudinal impact protection for containerized cargo, through an upper frame carrying the cargo which moves against a cushioning device which absorbs impacts engaged to a lower frame on the ISO carrier. The upper frame is movable within limits in the longitudinal direction allowing the upper frame to stroke with the loaded container at sudden impacts.

10 Claims, 7 Drawing Sheets

REMOVABLE CUSHIONED CONTAINER FLAT

This is a continuation-in-part of patent, application Ser. No. 07/586,785 filed Sept. 24, 1990, now abandoned, the contents of which are incorporated herein by reference.

TECHNICAL FIELD OF THE INVENTION

The present invention relates to a cargo carrying flat-rack (CCF) that provides longitudinal impact protection by cushioning cargo loaded on the flatrack during transport. The flatrack is used as an intermediate and separate unit between the cargo container being transported and the vehicular load carrier track carrying the container. The flatrack is particularly adapted to carry cargo containers that meet International Standard Organization (ISO) standards and at the same time engage load carriers that also meet ISO standards.

BACKGROUND OF THE INVENTION

Cushioning devices for freight containers or road trailers loaded on rail cars are known in the art. Two examples are the skeleton car with long travel cushion characteristics for transporting freight containers disclosed in U.S. Pat. No. 3,251,314 and the long travel cushioning arrangement for crane lift freight containers disclosed in U.S. Pat. No. 3,167,028. A third example is disclosed in U.S. Pat. No. 3,957,399, "A method for cushioning a containerized shipment by railroad flatcar". However all of the cushioning features shown in these patents are intended to be permanently fixed to the load carrier—so as to take advantage of the structural strength of the frame work in the load carrier. The existing designs are generally incorporated in the load carrier and not attached through the ordinary container locks on the load carrier as taught by the flatrack according to the invention. Accordingly, the conventional cushioning devices cannot be mounted and dismounted as quickly or easily as the flatrack of the invention. Further these permanently fixed devices result in logistical problems, since they travel with the load carrier rather than the route of a specific cargo container which requires special protection from longitudinal shocks during the time of its transport.

Further, the conventionally used freight container of the ISO 20 foot or 40 foot type have hollow castings in both top and bottom corners for respective lifting or locking of the container, from or to, a load carrier. The transverse and longitudinal distance between the centers of the lock receiving holes along the length and width of the containers is always the same, regardless of whether the container is 96 inch, 2,5 meter or 102 inch wide. The longitudinal distance between the center of the holes is such that the two 20 foot containers fit into one 40 foot container space of an ISO load carrier and two 20 foot containers can use the 40 foot container locking points.

To accommodate these conventionally used ISO containers, all ISO container load carriers are equipped with one of two types of locks for securing the containers to the carriers.

One type is the pedestal lock that has the shape of a 90 degree curb with a floor that the container corner slots into. Consequently, the container corner must always be placed inside the pedestal. The other type is the spigot type of lock that goes inside the corner casting on the container which both positions and locks the container to the carrier. With this lock, different widths and lengths of containers with the ISO standard locking points, can be locked.

The invention is directed to an cargo carrying flatrack cushioning device which overcomes the problems of prior art devices permanently fixed to its load carrier and and also accommodates conventional shipping containers and ISO vehicular load carriers on which such containers are transported.

SUMMARY OF THE INVENTION

The invention relates to a removable cushioning container flatrack that acts as an intermediate load carrier which is interchangeable with existing load carriers especially those accepted under ISO standards. The flatrack both cushions and locks any ISO container to any carrier adapted to carry such ISO containers without the need for any alterations to the existing container rail cars or road trailers.

The flatrack according to the invention can be lifted from the transport vehicle by means of conventional grappler lifts used to lift containers from ISO load carriers. Furthermore, there is no risk that the ends of cushioned containers loaded on the flatracks according to the invention can collide with non-cushioned containers that might be loaded on the same load carrier during transport. The invention also provides an ability to carry and lock 102 inch wide containers to a 96 inch wide pedestal lock on the carrier without the need for any intermediate pedestal lock castings.

The flatrack comprises two frames, a lower frame having container locking hole apertures such as corner castings of a type acceptable to ISO by which the flatrack can be fixed to the load carrier and an upper frame to which the loaded container or another flatrack can be fixed by locking mechanisms known in the trade such as twist locks. Said upper frame is slidably fixed in a manner that permits the upper frame to move in either direction along its longitudinal axis relative to the lower frame out to the ends of the lower frame. The flatrack further includes cushioning means engaged between the upper and lower frames which absorbs impacts during transport. The cushioning means is located at the center of the two frames with the longitudinal axis of the cushioning means parallel to the longitudinal axis of the frames.

The cushioned container flatrack (CCF) is designed so that it can carry and lock a containerized load such as an ISO container without adding more than approximately 8 inch (200 mm) to the total height of the container, but still protect the container from longitudinal impact during transportation by incorporation of the cushioning device between the upper and lower frames.

The CCF is constructed to fit into all existing types of container locking mechanisms found on ISO road or rail load carriers. The CCF can be loaded on the same carrier with other containers not engaged to a CCF without any risk of physical contact between the two containers. The CCF can be attached to a cargo container and handled as a part of the container or unloaded on its own with conventional equipment. The CCF can also be stacked on top of each other and up to 14 CCF can be locked together and handled as one unit if they are to be transported without cargo thereon.

The length of the upper frame corresponds to the container to be loaded but is shorter than the length of the lower frame. For example, the lower frame could be 24 feet long, whereas the upper frame is 20 feet long, thereby capable of receiving a 20 foot ISO type container. The lower frame is longer than the upper frame to provide a framework for the container hole apertures at the outer corners so that the flatrack can fit on any type of rail car container locks. At the same time the protruding lower frame provides the outer boundary for the movement of the loaded container and hence eliminates the risk of container collision. The upper frame is provided with twist locks used within the trade to lock the container to the flatrack.

As noted, an axially retractable energy absorbing cushioning device, mounted in a suitable framework such as a cushioning pocket or box, is located at the center of the two frames to absorb the impact force from movement of a container loaded on the upper frame. The cushioning device can be of any conventional design and is schematically illustrated in the drawing figures, but is preferably of the hydraulic type which provides a gas spring return similar to that found in shock absorbers. However, the cushioning device can also be of the type using a spring or elastomeric material return.

As noted, the cushioning device is located in a suitable framework such as a cushioning pocket or box. The pocket which is fixed to the lower frame is provided with buffer stops near each end of the pocket. These stops contain the cushioning device or buffer in its fully extended position in the center of the pocket and also serve to contain one end of the buffer during times that the other end is being compressed.

Buffer compression rods which are connected to the upper frame are provided to slide through the pocket, including the buffer stops in either longitudinal direction. When the container on the upper frame moves due to an impact, one compression 1od compresses the contained buffer against the opposite buffer stop, while the buffer absorbs energy for recoil. Thereafter, the buffer resets the upper frame with its load automatically to neutral resting position.

As noted, the buffer stops engage each end of the buffer in the cushioning pocket. Slots through the pocket and buffer stop permit the compression rods of the upper frame to compress the buffer in the pocket which is engaged to the lower frame.

The slots have a length corresponding to one stroke of the buffer and the length of the lower frame is one stroke longer at each longitudinal end than the length of the upper frame. This assures that the upper frame and its load are prevented from colliding with other cargo on the same load carrier.

The CCF may further be provided with an arrangement to block the cushioning capability when two or more CCF's are stacked on top of each other when transported empty.

DETAILED DESCRIPTION OF THE PREFERRED EMBODIMENT

Figure 1:
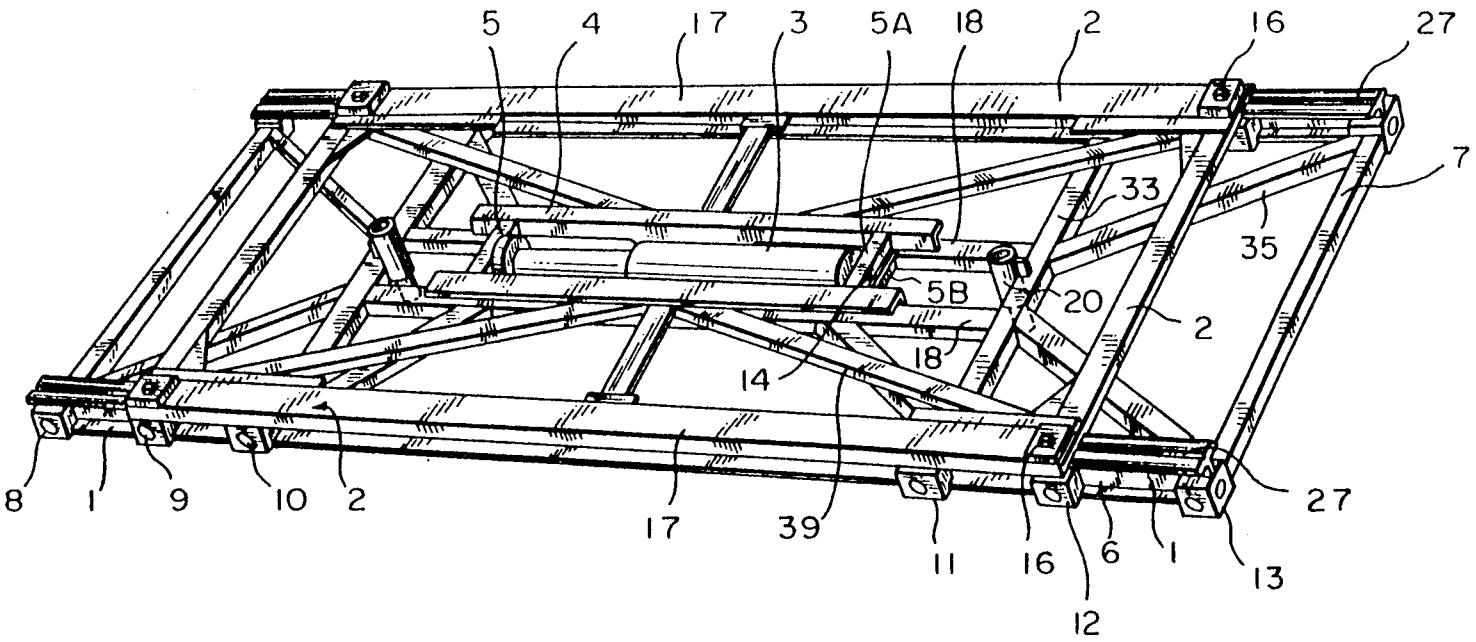
FIG. 1 is a perspective view of the cushioning flat according to the invention in resting position.
Figure 2:
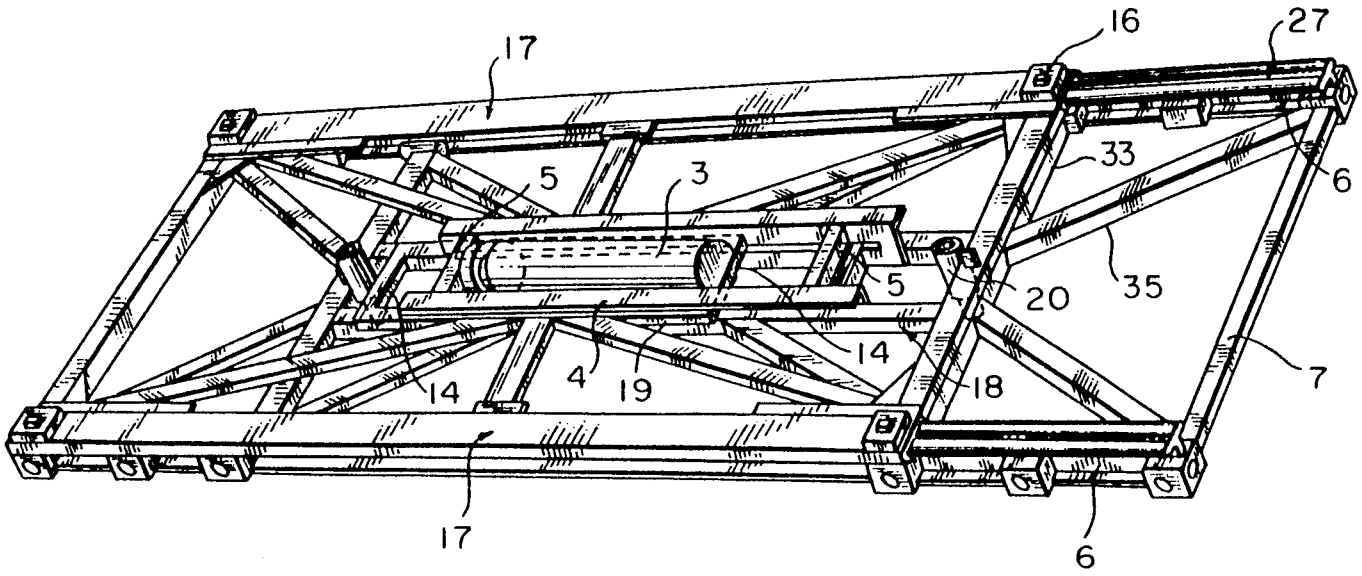
FIG. 2 is a perspective view of the cushioning flat according to the invention in one full stroke cushioning position.

The removable cushioned flat according to the invention consists as shown in FIGS. 1 and 2 of two frames, one lower frame (1) and one upper frame (2) and an energy absorbing cushioning or buffer device (3).

The lower frame (1) consists of an outer framework of two parallel longitudinal beams (6) having a I-shaped cross section. The ends of beams (6) are connected to two beams (7) to create a rectangular framework. Said rectangular framework is provided with six pairs of hollow corner castings (8,9,10,11,12,13), positioned at such distances that the flatrack fits onto all kinds of locks presently available on a vehicular load carrier of the standard ISO type. For example, castings (8) and (11) as well as (10) and (13) respectively, fit onto spigot locks available for a 20 foot ISO container. The alternative pairs of corner castings make it possible to choose different positions when loading depending on the types of locks available on the load carrier.

Pair (8) and (13) are suitable for loading on a carrier equipped with pedestal locks; (8) and (11) or (9) and (12) for spigot locks and pair (9)+(12) for stacking on another CCF. In order to avoid having to turn the CCF with the "right" end in a certain direction, pair (10) is added to make the CCF symmetrical so that pairs (10) and (13) could be used instead of pairs (8) and (11).

The extra pair of castings (10) make the flat symmetrical and eliminates the need to swing the flatrack around when it is being loaded on a vehicle with spigot locks when casting pair (13) is at the end of the flat that the loader faces adjacent the container on the load carrier.

The rectangular framework of the of the lower frame 1 is further provided with two transverse reinforcing beams (33) and four oblique beams (35) as shown in FIGS. 1 and 2. However, reinforcing can be of any suitable type such as partial or complete covering plates.

Figure 3:
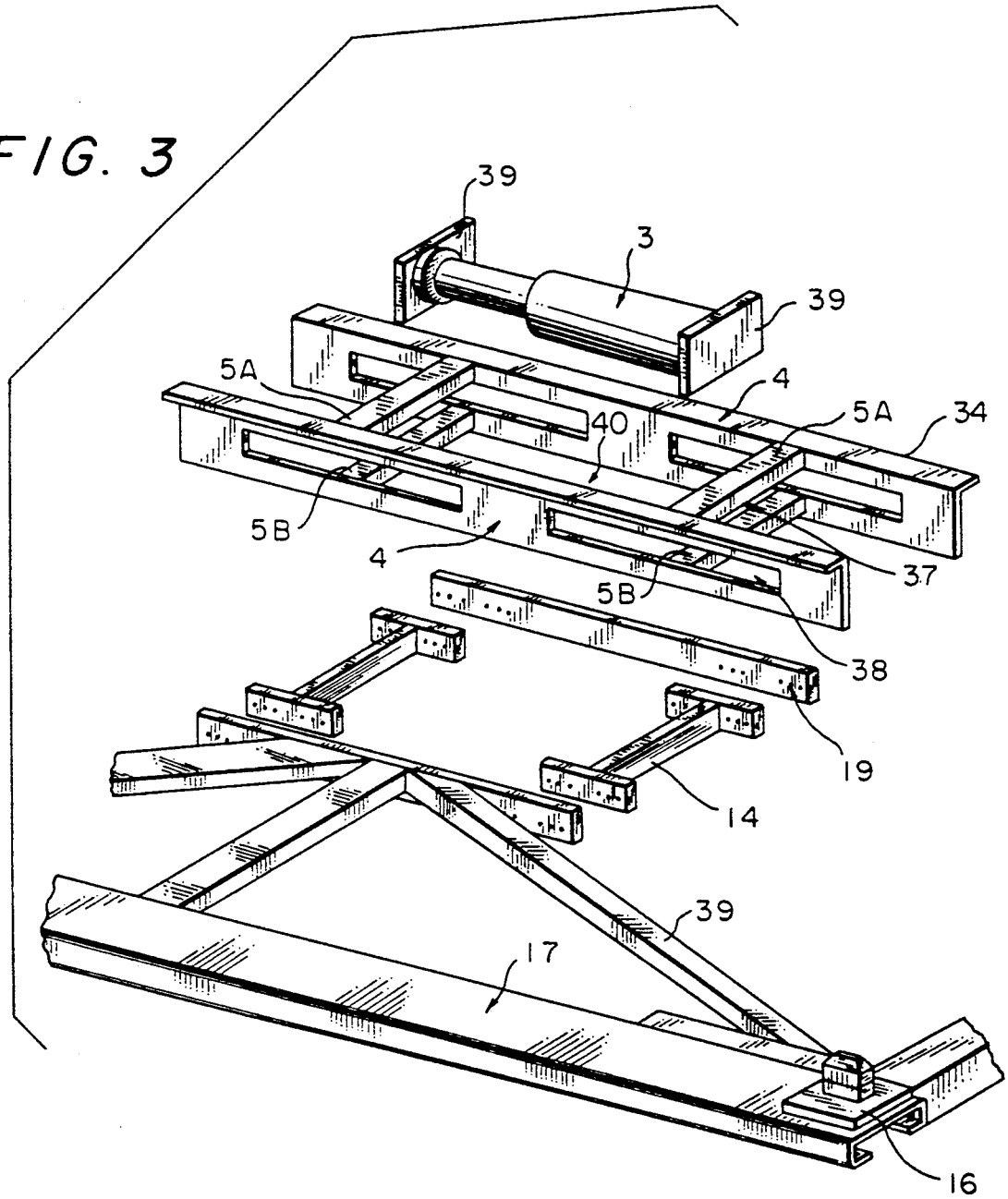
FIG. 3 is a perspective exploded view of the cushioning device, cushioning device retaining pocket and a section of the upper frame of the flatrack which slides on the pocket.
Figure 4:
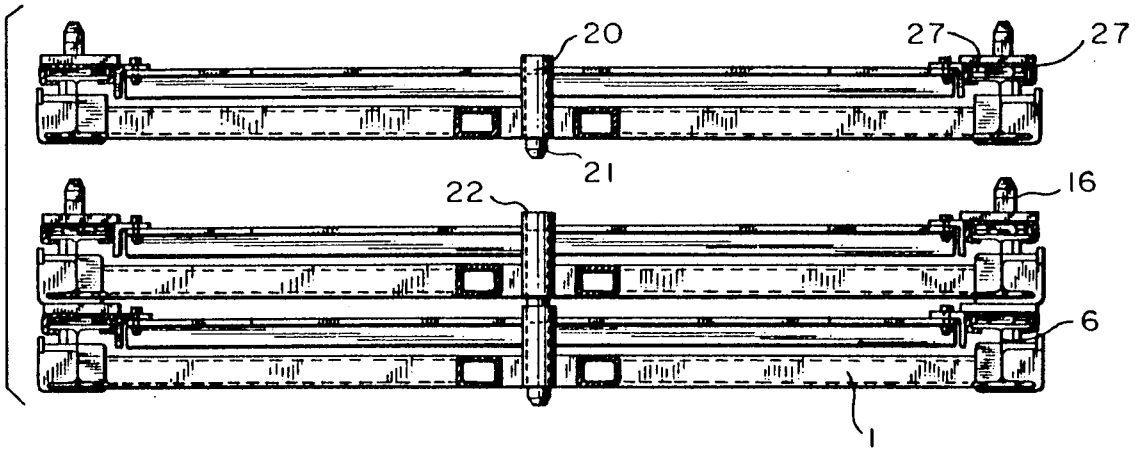
FIG. 4 shows a cross section A—A of FIG. 5 of two stacked CCF flatracks and a third to be stacked.
Figure 5:
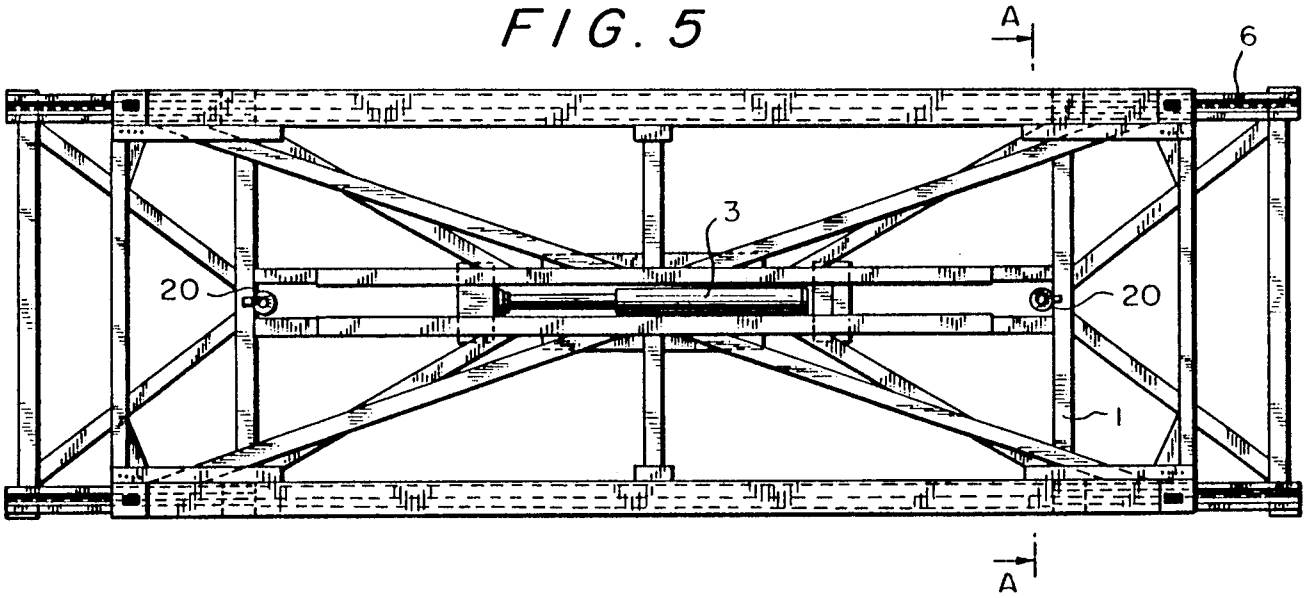
FIG. 5 shows the position of the stack locks on the lower frame of the flatrack.
Figure 7:
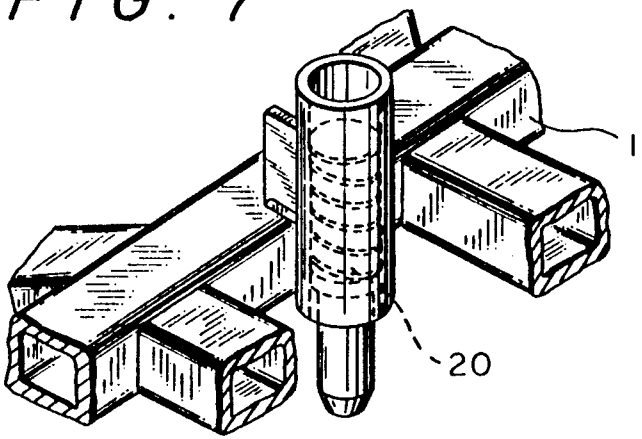
FIG. 7 shows the stack lock welded onto the lower frame of the flatrack.
Figure 6:
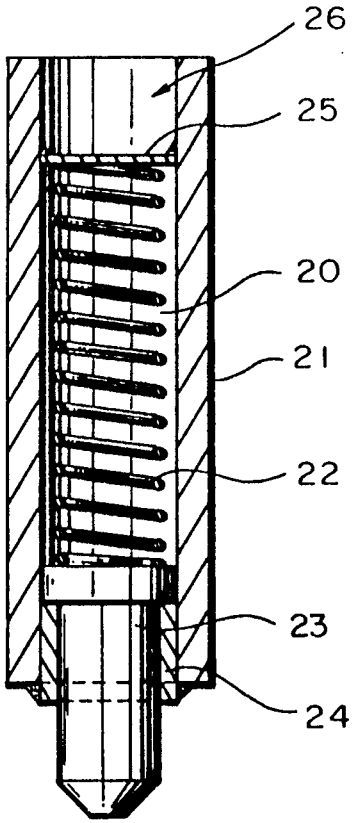
FIG. 6 is a cross section of the stack lock with the steel tube and spring and spring loaded pin.

The cushioning pocket (34) as shown in FIGS. 1, 2 and 3 comprises slotted longitudinal rails (4) connected by transverse buffer stops 5A and 5B. Buffer stops 5A and 5B engage each end of the buffer (3) by compression in pocket (34)

FIGS. 1, 2 and 3 show the buffer pocket (34) with slots (37) and (38) accommodating buffer compression rods (14). These figures also show that upper frame (2) has compression rods (14) bolted to two connecting rods (19) which in turn are fixed to guide plates (17) through four diagonal beams (39). Lower frame (1) is further provided with perpendicular longitudinal beams (18) as shown in FIGS. 1 and 2 which are fixed to the lower edge of slotted rails (4) of pocket (34).

As shown in FIGS. 1 and 2, the upper framework (2) comprises two longitudinal sliding guide channels (17)

having a C-shaped cross section engaged to the lower frame (1) so that upper frame (2) can slide longitudinally on top of the lower frame. This is accomplished by the C-shaped cross section of sliding guide channels (17) enveloping the top flange of the I-beam (6). The guide channels (17) have the same length as an ISO container and are provided at their ends with container lock arrangements (16) that fit into the corner castings of a standard ISO container. This arrangement is shown in the drawings as manual twistlocks (16). In order to facilitate the sliding of the guiding channel (17) over the lower frame a low friction material (27) such as tetrafluoroethylene can be inserted between the guide channels (17) and the top flange of I-beam (6).

When assembled and engaged to a vehicular load carrier, the upper frame of the flatrack carrying the cargo container is free to move longitudinally in relation to lower frame (1) which is engaged to the load carrier against the cushioning device or buffer (3) located in pocket (34). Thus, when a longitudinal force is imparted to the load carrier, it moves upper frame (2) and the loaded cargo container against cushioning device or buffer (3) which absorbs the impact.

This is achieved as follows with reference to FIGS. 1, 2 and 3, the guide channels (17) are connected to the buffer compression rods (14). Compression rods (14) are mounted to slide through the openings (37) between buffer stops 5A and 5B of pocket (34) and along slots (38) in longitudinal rails (4). As compression rods (14) slide in either direction in slots (38) depending on the direction of impact on the load carrier they compress buffer (3) which absorbs the impact and returns frame (2) to its normal position. The slots at each end of pocket (34) have a length corresponding to the stroke of the buffer. The sides of pocket (34) are unbroken in the middle thereby providing a limit on compression of the buffer by compression rods (14).

The cushioning device (3) can be of any conventional design known in the prior art but is preferably of the hydraulic type which provides a gas spring return similar to that found in a shock absorber. However, the cushioning device can also be of the type using a spring or elastomeric material return.

A floor (40) is provided in pocket (34) below cushioning device (3) to protect the buffer from damage and dirt during service and to provide a surface on which identical sized flanges (39) connected at ends of buffer (3) ride during operation to maintain alignment of the buffer. Flanges (39) of buffer (3) are not fixed in pocket (34), but are maintained against buffer stops (5A) and 5B) by compression of buffer (3) in pocket (34). Flanges (39) also serve to distribute the force imparted to buffer (3) by compression rods (14) when upper frame (2) moves on lower frame (1).

A removable ceiling plate (not shown) can also be provided on pocket (34) to further protect the buffer from damage and dirt during service.

As noted, the cushioning device (3) is longitudinally axially retractable and during an energy absorbing impact stroke, stores energy for the recoil which will reset the upper frame with its load automatically to the neutral resting position.

The total stroke on the buffer (3) in one direction is 2 feet. The design of the buffer pocket (34) and the fact that the upper frame (2) can compress the buffer from both ends, makes the total movement and stroke of the upper frame twice the buffer stroke or 4 feet-2 feet in each direction.

The buffer pocket (34) design permits one buffer (3) to do the job of two buffers as is normally required in prior art devices fixed to the load carrier. Further, the compression rods (14) of upper frame (2) in combination with pocket (34) impart the force to be absorbed by buffer (3) within a height which adds only 8 inches to the floor of load carrier without the need to be made permanently part of the load carrier with the disadvantages already discussed.

FIGS. 4–8 show how the stack-lock feature of the invention operates in cooperation with the flatrack. This stack-lock feature consists of a spring loaded pin (23), positioned at the bottom of a steel tube (21) and prevented from falling out by the larger diameter on the top part of the pin that is stopped by a bushing (24) fitted at the bottom of the tube (21). The pin (23 is kept in an extended position at the bottom of the steel tube (21) by a coil spring (22) that is placed above the pin head inside the steel tube and slightly compressed and positioned by a washer (25) that is welded above the spring (22) inside the steel tube (21). The steel tube (21) extends above the washer (25) to provide a hollow round space (26).

Space (26) provides the space for pin (23) from another CCF stacked on top. Two steel tubes 21, with their parts (22–25), are firmly welded to the lower frame of the CCF, one at each end of the buffer pocket frame. The top part of the stack-lock (20) extends above the tube frame work welded in between the I-beams (6) on the lower frame, so that the top of the stack-lock (20) is level with the loading surface on the twistlocks (16) on the upper frame. The stack-lock (20) is welded to the lower frame in such a position that it will not interfere with the longitudinally moving beams on the upper frame (2) when the upper frame is stroking in either direction.

When stacking a flatrack equipped with the stack-locks (20), the four hollow corner castings (9) and (12) of the flatrack being stacked is placed directly above the four twistlocks (16) on the first flatrack and lowered down so that the twistlock heads go inside the hollow corner castings and the bottom surface on the corner castings rests on the flat loading surface on the twistlocks (16). The spring loaded pins (23) in the stack-locks (20) of the flatrack being stacked are placed directly above the hollow top part (26) of the stack-locks on the first flatrack, allowing the pins (23) to project into the hollow space (26) in the stack-locks of the first CCF. This longitudinally fixes the lower frame (1) in the first flatrack together with the lower frame (1) of the stacked flatrack. This prevents the lower frame (1) of the stacked flatrack from moving relative to the upper frame (2) in the first CCF. The upper frame (2) on the stacked flatrack can still move, but since it is not an accumulated stroke length, this upper frame (2) cannot move beyond the boundaries of the lower frame of the first CCF and there is therefore no need to lock it.

Figure 8:
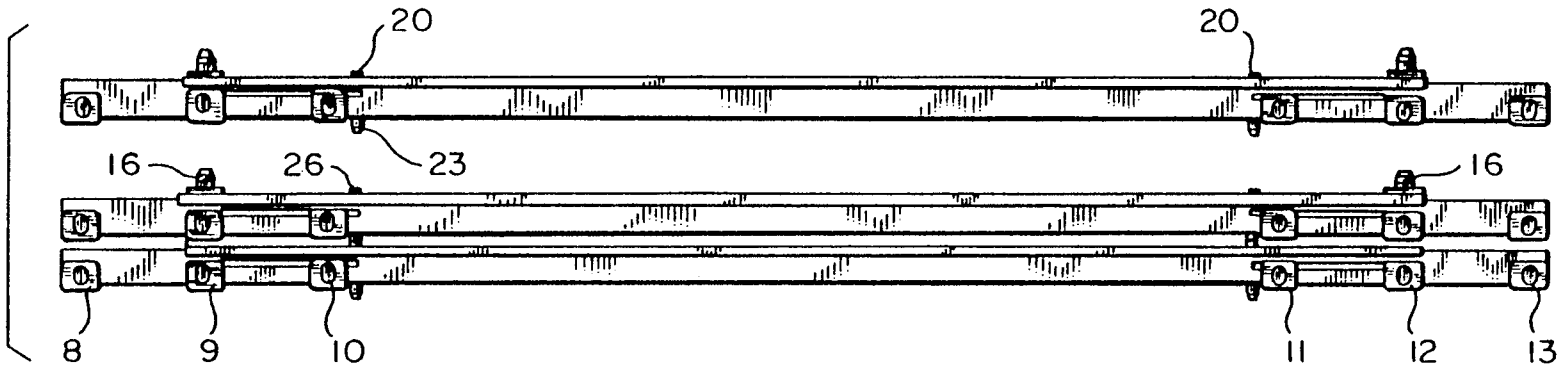
FIG. 8 shows a side view of two stacked flatracks and a third to be stacked.

FIG. 8 more specifically shows how the six pairs of corner castings and the twistlocks (16) will go inside the hollow corner casting in pair (9) and (12) when the CCF that are going to be stacked are placed exactly above the CCF that is stacked on. It also shows how the stack-locks (20) with the stack-lock pin (23) will engage into the space (26) at the top of the stack-lock in the CCF below.

Figure 9:
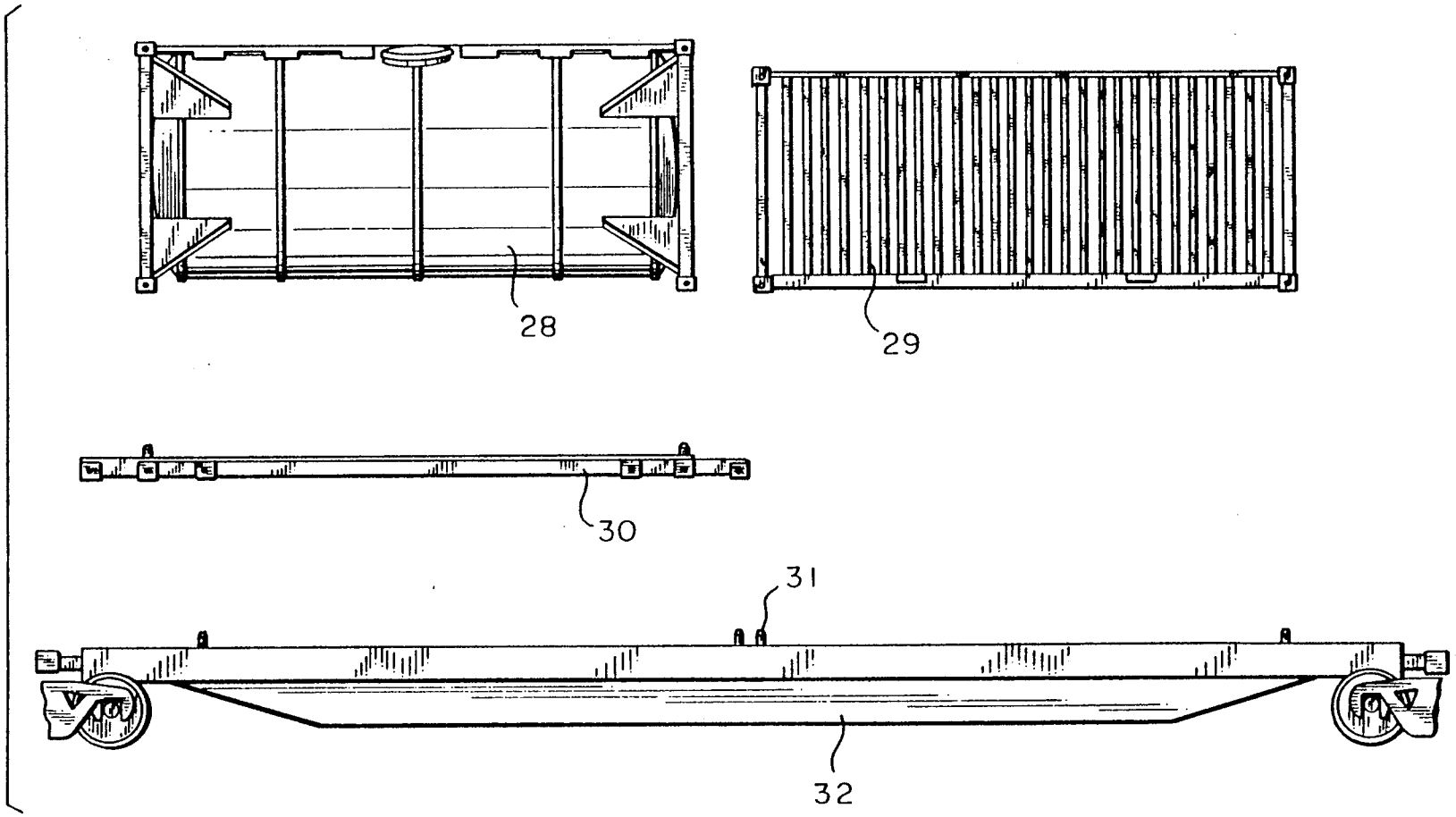
FIG. 9 shows a typical loading procedure on a rail car equipped with spigot type of container locks with a non-cushioned container which can be loaded next to a flatrack which can carry a conventional container.

FIG. 9 shows a typical loading procedure on a 50 foot rail car (32) equipped with spigot type of container locks (31). The non-cushioned container (29) can be loaded next to the CCF (30) that is intended to carry a container (28) that will be longitudinally cushioned, on the existing container locks (31) provided on the car.

When transporting tank containers on rails it is essential that the rail car can properly protect the naked shell of the tank from loose objects such as ballast pebbles. Such protection is however, not offered by the double stack deep loading well cars, since they are manufactured without floors. The CCF according to the invention can offer a solution to this problem since it can be supplied with a floor of suitable material such as e.g. light weight expanded metal (not shown) in the framework of the lower bottom container in the double stack bar.

What is claimed is:

1. A stackable cargo carrying flatrack cushioning device for transporting a cargo container on an ISO vehicular load carrier and adapted to engage another said flatrack above and below said flatrack to permit a plurality of said flatracks to be transported on said carrier, said container having lock receiving devices at positions adapted to engage locking devices on said ISO load carrier, said stackable cargo carrying flatrack cushioning device comprising:

a rectangular lower frame having a predetermined length;

a rectangular upper frame having a length corresponding to said container and shorter than the length of said lower frame;

means on said upper frame for slideably engaging said lower frame;

cushioning means engaged to said lower frame for resiliently absorbing movement of said upper frame relative to said lower frame and also limiting the sliding of said upper frame when a first or second end of said upper frame respectively reaches a first or second end of said lower frame;

locking means on said upper frame for engaging either said lock receiving devices of said cargo container or lock receiving means on a lower frame of another said flatrack stacked above said flatrack; and lock receiving means on said lower frame for engaging said locking devices on said ISO load carrier or locking means on an upper frame of another said flatrack stacked below said flatrack.

2. The carrying cargo flatrack of claim 1, further comprising:

stack means fixed to said lower frame for stacking said another said flatrack above said flatrack and precluding movement of said upper frame relative to said lower frame of said flatrack when said another said flatrack is stacked above said flatrack;

wherein said flatrack can be used to cushion transportation of said container on said ISO vehicular load carrier or be stacked on said carrier without said container.

3. The cargo carrying flatrack of claim 2, wherein said means on said upper frame for slideably engaging said lower frame comprises:

said rectangular upper frame having two longitudinal channels; each of said channels having a C-shaped cross section opening downward;

said rectangular lower frame having two longitudinal beams; each of said beams having an I-shaped cross section;

each said C-shaped cross section of said channels respectively slideably engaged around a top flange of each said I-shaped cross section of said beams; and anti-friction means disposed on an upper surface of said top flange for facilitating the sliding of said channels relative to said beams.

4. The cargo carrying flatrack of claim 3, wherein said anti-friction means is tetrafluorethylene.

5. The cargo carrying flatrack of claim 2, wherein said lock receiving means comprise at least five pairs of ISO corner castings located on said lower frame at such distances in relation to each other to accommodate said locking devices on said ISO load carrier or locking means on an upper frame of another said flatrack stacked below said flatrack.

6. The cargo carrying flatrack of claim 5, wherein said lock receiving means comprise two sets of three pairs of ISO corner castings; one of said two sets symmetrical to the other set around a central transverse axis of said flatrack.

7. The cargo carrying flatrack of claim 2, wherein said cushioning means comprises:

a rectangular pocket fixed to said lower frame;

said pocket comprising;

slotted longitudinal sides;

transverse buffer stops fixed near opposite ends of said longitudinal sides;

said transverse buffer stops having slots communicating with said slots in said slotted longitudinal sides;

a resiliently compressible buffer fixed between said buffer stops in said pocket by compression;

said upper frame having integrally connected compression rods, wherein said compression rods slide in either longitudinal direction in said pocket to additionally resiliently compress said buffer to absorb movement of said upper frame relative to said lower frame.

8. The cargo carrying flatrack of claim 7, wherein said buffer has hydraulic means for providing resiliency.

9. The cargo carrying flatrack of claim 7, wherein said buffer has a spring to provide resiliency.

10. The cargo carrying flatrack of claim 7, wherein said buffer has elastomeric means for providing resiliency.

* * * * *